US009127332B2

(12) United States Patent
Frank et al.

(10) Patent No.: US 9,127,332 B2
(45) Date of Patent: Sep. 8, 2015

(54) MOLTEN ALUMINUM REFINING AND GAS DISPERSION SYSTEM

(75) Inventors: Robert A. Frank, Killingworth, CT (US); Michael S. Klepacki, Newtown, CT (US)

(73) Assignee: Pyrotek, Inc., Spokane, WA (US)

( * ) Notice: Subject to any disclaimer, the term of this patent is extended or adjusted under 35 U.S.C. 154(b) by 648 days.

(21) Appl. No.: 12/075,476

(22) Filed: Mar. 11, 2008

(65) Prior Publication Data

US 2009/0229415 A1 Sep. 17, 2009

(51) Int. Cl.

| | |
|---|---|
| ***C22B 21/06*** | (2006.01) |
| ***C22B 9/05*** | (2006.01) |
| ***C22B 9/10*** | (2006.01) |

(52) U.S. Cl.

CPC ..... *C22B 21/064* (2013.01); *C22B 9/05* (2013.01); *C22B 9/103* (2013.01)

(58) Field of Classification Search

CPC ..... C22B 21/064; C22B 9/05; C22B 9/103; C22B 21/062; F27D 27/00; F27D 3/16

USPC ..... 266/266, 225, 217, 216, 235, 233, 265, 266/267, 268; 75/678, 708, 671, 680; 222/603

See application file for complete search history.

(56) References Cited

U.S. PATENT DOCUMENTS

| | | | | | |
|---|---|---|---|---|---|
| 3,743,263 | A | | 7/1973 | Szekely | |
| 3,870,511 | A | * | 3/1975 | Szekely | 75/680 |
| 4,047,938 | A | * | 9/1977 | Szekely | 75/602 |
| 4,460,393 | A | | 7/1984 | Saget | |
| 4,931,091 | A | * | 6/1990 | Waite et al. | 75/680 |
| 5,028,035 | A | * | 7/1991 | Baud et al. | 266/217 |
| 5,160,693 | A | | 11/1992 | Eckert et al. | |
| 5,198,180 | A | | 3/1993 | Pelton | |
| 5,364,078 | A | * | 11/1994 | Pelton | 266/233 |
| 5,536,296 | A | * | 7/1996 | Ten Eyck et al. | 75/681 |
| 5,678,807 | A | * | 10/1997 | Cooper | 266/216 |
| 5,935,295 | A | * | 8/1999 | Megy | 75/680 |
| 6,056,803 | A | * | 5/2000 | Waite | 75/678 |
| 6,060,014 | A | * | 5/2000 | Pelton | 266/242 |
| 7,669,739 | B2 | * | 3/2010 | Schmeisser | 222/603 |
| 8,178,036 | B2 | * | 5/2012 | Neff et al. | 266/235 |
| 2010/0052227 | A1 | * | 3/2010 | Neff et al. | 266/217 |

* cited by examiner

*Primary Examiner* — Scott Kastler
*Assistant Examiner* — Michael Aboagye
(74) *Attorney, Agent, or Firm* — Wells St. John, PS

(57) ABSTRACT

Aspects of this molten aluminum refining system include a rotor based injection system which provides for the injection and dispersion of both gas and flux for refining molten aluminum.

9 Claims, 9 Drawing Sheets

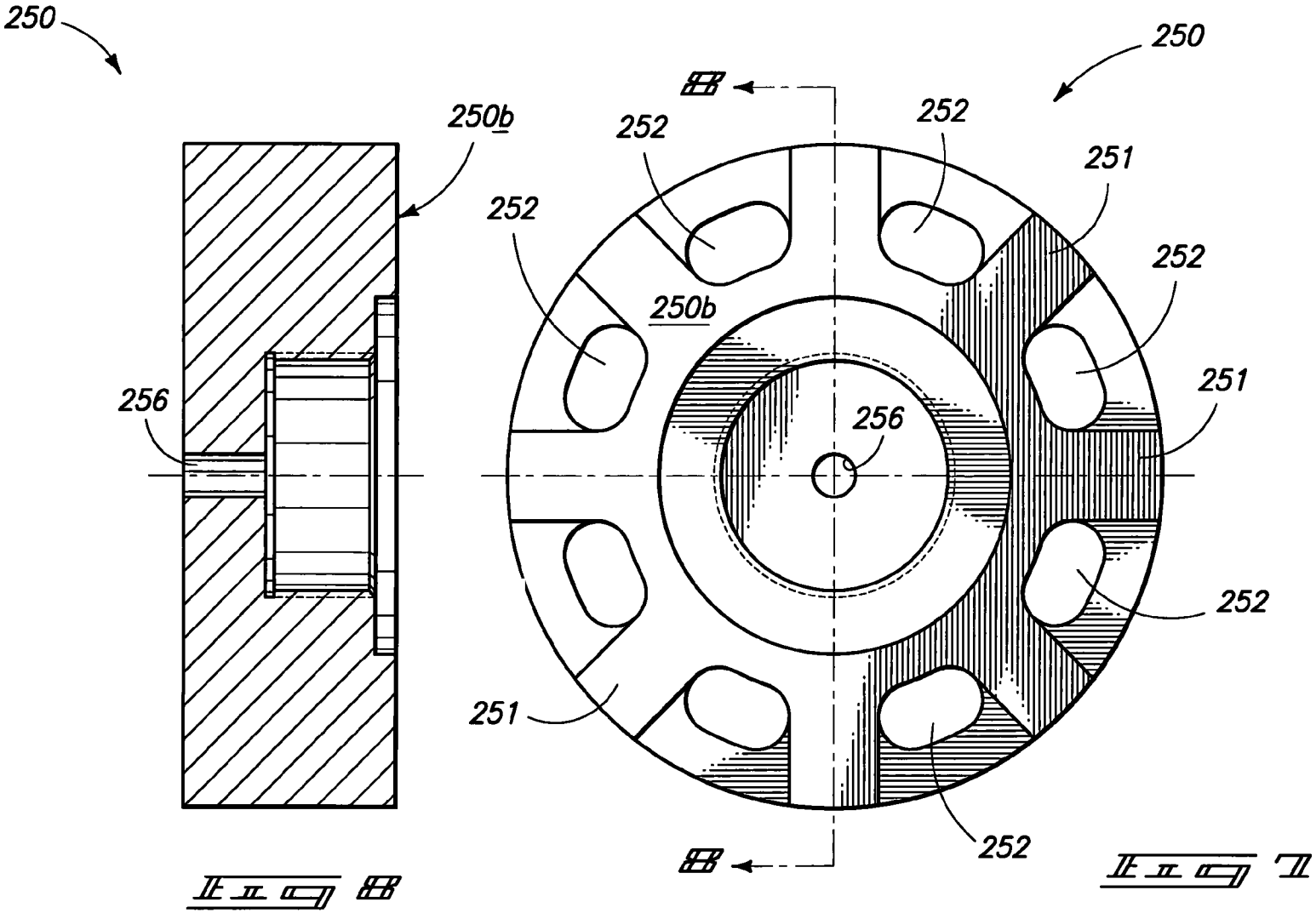
250
251
252
256
250b
II
II

MOLTEN ALUMINUM REFINING AND GAS DISPERSION SYSTEM

CROSS REFERENCE TO RELATED APPLICATION

This application does not claim priority from any other application.

TECHNICAL FIELD

This invention relates to a molten aluminum refining system, more particularly a rotor based system for injecting gas or gas, flux and/or other material into molten aluminum.

BACKGROUND OF THE INVENTION

In the processing of molten aluminum, it is desirable to remove certain gases and other material or elements from the molten aluminum before further processing, and depending upon the specific application or process. The equipment or function may generally be referred to as a degasser or degassing.

In a typical application of a degasser for molten aluminum, dissolved hydrogen from any one or more of multiple potential sources, is a targeted gas to be removed from the melt prior to the next step in the process (such as casting for instance). If for instance hydrogen remains in the aluminum during casting, hydrogen coming out of solution may cause any one or more of cast problems, such as twisting, flaking, blisters or even cracking. It is typically desirable to remove the dissolved hydrogen just prior to the next step in the process.

The particular dissolved hydrogen content in a given application may vary substantially, but can range from 0.20 ml/100 g Al for general extrusion billet down to 0.10 ml/100 g Al for rolling slab for aerospace types of applications.

Typically hydrogen is removed from the molten aluminum by introducing or bubbling an inert gas through the metal. Examples of inert gases which may be utilized include argon or nitrogen.

In addition to the removal of the hydrogen through the utilization of inert gases, it is also typical to desire to remove other impurities and/or inclusions during the refining process, and this removal may also occur or be desired during this degassing process. For instance, the addition of smaller amounts of chlorine in the inert gas may remove different inclusions and alkali metal impurities in a relatively efficient way. Inclusions in molten aluminum may come from any one or more different sources during the smelting operation, in the molten metal furnace or from intentionally added material such as grain refiners. The failure to adequately remove inclusions may result in tears and surface defects in rolling sheet aluminum, pinholes and increased die wear during extrusion. It is typical in some applications to target the removal of approximately 50% of non-wetted inclusions in the degassing system. Later filtering of the molten aluminum downstream from the degassing system would typically be utilized to further reduce inclusions in the molten metal.

A typical degasser system, or molten aluminum refining system for the removal of gases which utilizes a rotor within a stator, would typically involve the injection of an inert gas utilizing one or more injectors or injection devices, such as a spinning rotor device. The injector would typically introduce the inert gas, such as Argon, into the molten metal through numerous bubbles that the injector may shear and disperse into the molten metal in order to saturate the molten metal with the inert gas. In systems which do not use a stator, gases may be injected through the center of the rotating rotor shaft—however in many applications it is desired or preferred to utilize a stator for process and other reasons.

The inert gas is typically introduced into the molten metal near the bottom of the containment vessel and the bubbles of gas are dispersed and allowed to rise to the melt surface, desorbing the dissolved hydrogen in the process. The addition of chlorine as mentioned above in small amounts (such as 0.5% or less) may assist in breaking the bond between the molten aluminum and any non-wetted inclusions in the molten aluminum, thereby allowing the inclusions to more readily attach to the rising gas bubbles and be buoyed or lifted to the melt surface of the molten aluminum. Additional amounts of chlorine may be added to the inert gas to chemically react with incoming alkali metals such as sodium, lithium, calcium, or others, to form chloride salts that also float to the surface or melt surface of the molten aluminum.

Typically the inclusions and solid salts and other material that float to the melt surface form what is referred to as dross, which can then be skimmed from the surface and removed as waste.

It is typically desirable to maximize the saturation of the molten aluminum with small gas bubbles and to maintain a flat or calm melt surface to better facilitate the floating and capturing of inclusions and salts to the melt surface. Achieving these objectives will generally result in better separation of the molten aluminum from the dross. There are many factors that contribute to the efficiency of these systems, such as the nozzle or injector design, gas flow rates, the flatness of the molten aluminum melt surface, vessel chambered geometries, and others.

Some prior art injectors utilize a spinning rotor within a static stator to strive toward the desired saturation level, with the spinning rotor being attached or integral with a nozzle portion. The spinning rotor may actually be used to shear and help disperse the gas bubbles and any additions thereto, into the molten aluminum. It is also desirable, in order to maintain the melt surface relatively still or flat, to avoid a vortex effect from the rotation of the rotor. A vortex affect would tend to cause disruptions in the surface, a partially mixing or dispersion of the material in the dross with the molten aluminum, and generally interfere with or hinder the removal of undesirable gas and inclusions.

One example of a molten aluminum degassing or metal refining system is one offered by Pyrotek under the SNIF trademark. References and information relative to the Pyrotek products may be found at its website at www.pyrotek-inc.com.

Prior United States patents referring to such prior art systems, include the following: U.S. Pat. No. 5,198,180, for a Gas Dispersion Apparatus with a Rotor and Stator for Molten Aluminum Refining; U.S. Pat. No. 5,846,481, for a Molten Aluminum Refining Apparatus; U.S. Pat. No. 3,743,263, for an Apparatus for Refining Molten Aluminum; and U.S. Pat. No. 4,203,581, for an Apparatus for Refining Molten Aluminum; all of which are hereby incorporated in their entirety by this reference as those set forth fully herein.

In a typical prior art configuration for molten aluminum refining, one or more injectors such as injector 130 in FIG. 2, would be located within the molten aluminum or molten metal, and the gases would be introduced through that injector as described below.

It is also desirable to reduce the dissolved gas content and the non-metallic in purity content of the molten aluminum, and this is typically accomplished by utilizing any one or more of various fluxing processes, which is where the molten metal is contacted with either reactive gaseous or solid fluxing agents (such as halogens). Chlorine gas for instance may be utilized in the removal of the non-metallic impurities. If it is desired in a given application to also introduce flux into the molten aluminum, a separate piece of equipment, namely a device such as a flux injector, is introduced into the molten metal and flux is thereby delivered or injected into the molten aluminum. This requires an additional expense, additional capital outlay for the machinery, and additional maintenance thereon.

It is therefore an objective of embodiments of this invention to provide a molten aluminum refining system which will allow for the injection of gas and flux while utilizing a spinning rotor within a static stator.

While the invention was motivated in addressing some objectives, it is in no way so limited. The invention is only limited by the accompanying claims as literally worded, without interpretative or other limiting reference to the specification, and in accordance with the Doctrine of Equivalents. Other objects, features, and advantages of this invention will appear from the specification, claims, and accompanying drawings which form a part hereof. In carrying out the objectives of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 7 is a top view of the rotor illustrated in FIG. 4;

FIG. 8 is section 8-8 from FIG. 7;

FIG. 9 is a top view of another embodiment of a rotor which may be utilized in embodiments of this invention;

FIG. 12 is a top view of another embodiment of a rotor which may be utilized in embodiments of this invention; and FIG. 13 is section 13-13 from FIG. 12.

DETAILED DESCRIPTION OF THE PREFERRED EMBODIMENTS

Many of the fastening, connection, manufacturing, and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention. The practice of a specific application or embodiment of any element may already be widely known or used in; the art or by persons skilled in the art or science and therefore each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
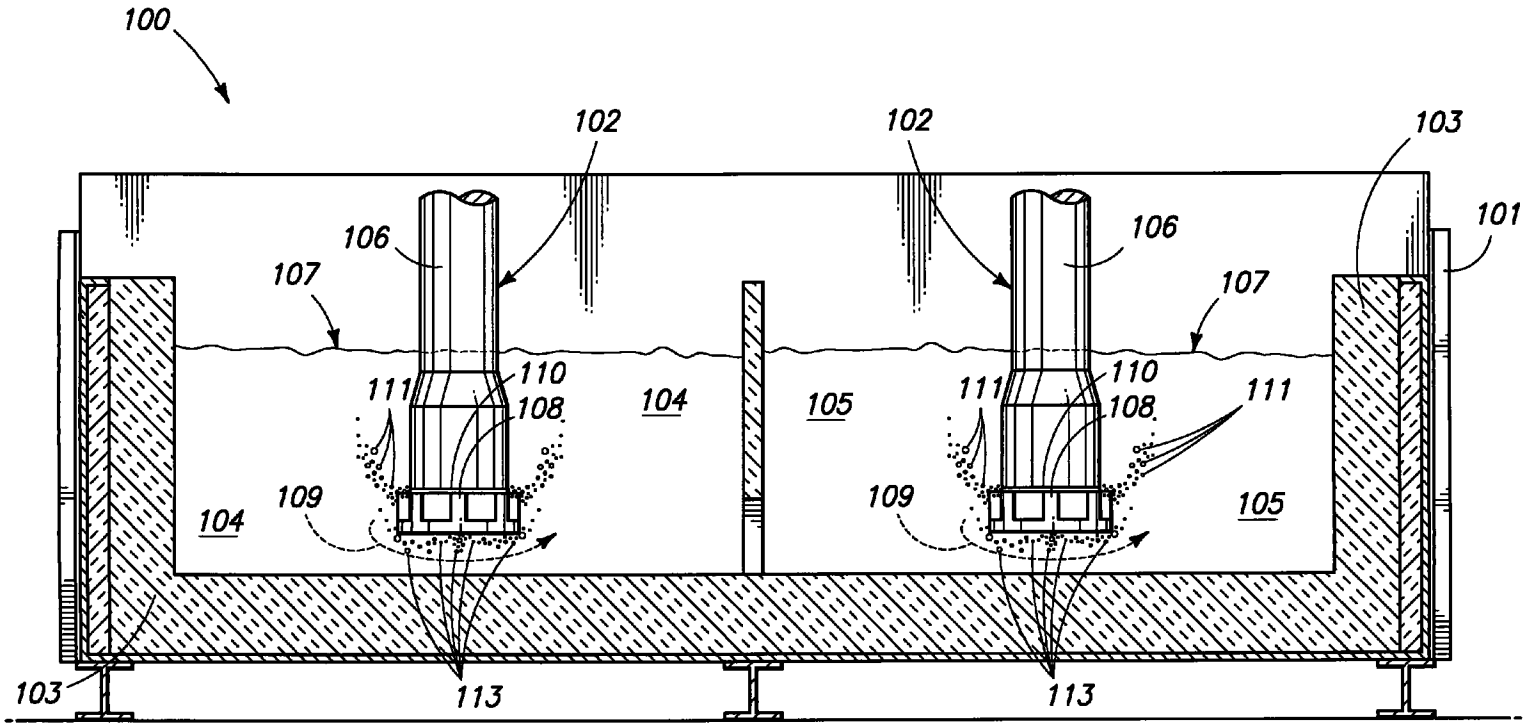
FIG. 1 is an elevation view of one embodiment of a molten aluminum refining system contemplated by this invention.

FIG. 1 is an elevation view of one embodiment of a molten aluminum refining system 100 contemplated by this invention, such as a containment or refining vessel 101, illustrating two injectors 102, refractory lining 103, stators 106 within vessel compartments 104 and 105 (which may also be referred to as refining chambers individually or collectively), molten metal level 107, such as molten aluminum. The two spinning rotors 108 are spinning as indicated by arrows 109 and gas bubbles including flux 113 are being dispersed from a central passageway or central passageway, and gas bubbles 111 which do not contain flux are being dispersed from between the stators 106 and the rotor 110.

Figure 2:
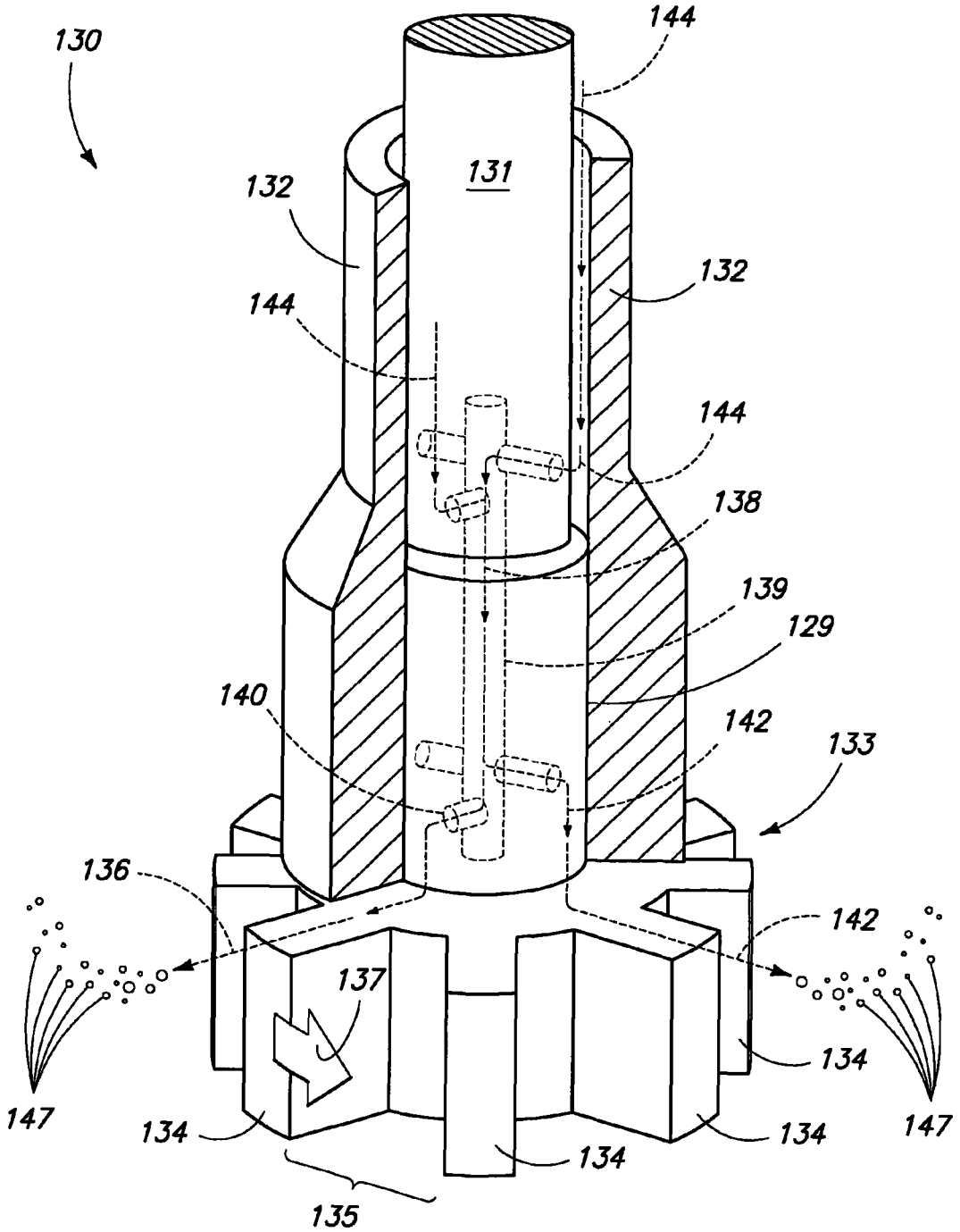
Fig 2 PRIOR ART
FIG. 2 is a perspective cutaway view of a prior art molten metal refining system.

FIG. 2 is a perspective cutaway view of a prior art molten metal refining system 130, or injector 130, illustrating rotor shaft 131, stator 132, spinning rotor 133 attached to rotor shaft 131, with arrow 137 illustrating the rotation of spinning rotor 133. Spinning rotor 133 includes a plurality of blades 134 (or vanes) with space 135 there between.

FIG. 2 illustrates an example of prior art gas introduction or injection through the metal refining system, with gas arrow 144 illustrating the flow between stator 132 and rotor shaft 131. The gas then enters passageways 140 within rotor shaft 131, with passageways 140 being a portion thereof, and exits in the gap between the spinning rotor 133 portion (may also be referred to as a spinning nozzle) of the rotor shaft 131 and the stator 132 as indicated by arrows 136 and 140. Primary passageway 139 may include one or more inlets for the gas in one or more gas outlets 140, showing gas 142 exiting the same.

As can also be seen from FIG. 2, the rotor shaft 131 is rotatably positioned within the internal cavity within stator 132 such that it may be driven by a motor or other drive within the stator 132 cavity. The rotor shaft 131 is operably attached to the spinning rotor 133 such that the nozzle rotates with the rotor shaft 131. A gas passageway is also provided between the internal cavity surface of the stator 132 and the outer surface of the rotor shaft 131 such that gases 144 may pass through the passageway before being discharged between the bottom of the stator 132 and the top of the spinning rotor 133.

FIG. 2 also illustrates where the outer surface of the rotor shaft 131 interacts with the interior surface of the stator 132, with that intersection identified as item 129, which may also be referred to as gap 129. The area of that intersection may be referred to as a bushing, a bearings or using other terms, and there may in some embodiments be a two to four one-thousandths of an inch clearance between the two components. It is typically desirable to maintain a certain pressure of gas below that gap 129 so that molten metal does not enter the gap 129 at the lower end near the rotating rotor 133.

The gas from both passageways is discharged and preferably sheared between the top of the spinning rotor 133 and the bottom of the stator 132, and the vanes 134 of the spinning rotor 133 contribute to the sheering of the gas bubbles 147 and dispersion thereof within the molten metal surrounding the spinning rotor 133. In typical applications utilizing the gap 129, only gas is utilized in connection with the stator 132 and rotor configuration.

FIG. 2 illustrates gas bubbles 147 exiting and then dispersed throughout the molten metal in which the injector 130 is operating. The gas bubbles 147 exiting the injector 130 are more buoyant than the molten aluminum and therefore float upwards towards the surface of the molten aluminum, the melt surface.

In the prior art example illustrated in FIG. 2, there is no real provision for the introduction of flux into the molten aluminum where the gas bubbles 147 are released. In a typical prior art system, there would be a separate flux injector that would be moved into the molten metal and through which flux would be injected.

Figure 3:
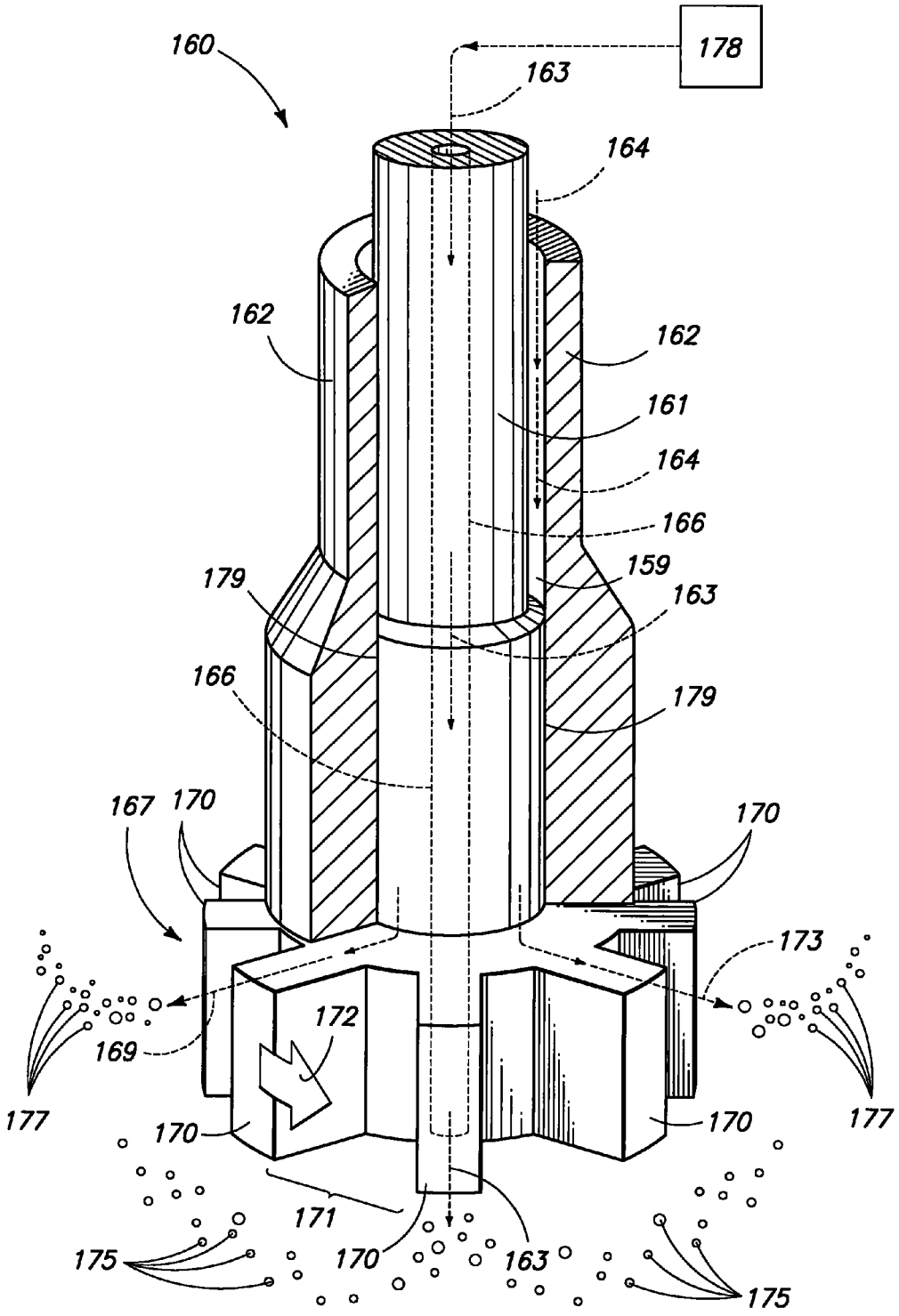
FIG. 3 is a perspective cutaway view of one embodiment of a molten metal refining system contemplated by this invention.

FIG. 3 is a perspective cutaway view of one embodiment of a molten metal refining system 160 contemplated by this invention. FIG. 3 illustrates an injector which in this embodiment includes stator 162, rotor shaft 161, passageway between the stator 162 and the rotor shaft 161 through which gas 164 is passed in the manner illustrated in the prior art example shown in FIG. 2. Spinning rotor 167 includes blades 170 (or vanes) with space or distance 171 there-between. Gas bubbles 177 which include gases are released as indicated by arrows 169 and 173 into the molten aluminum for dispersion.

FIG. 3 also illustrates a central passageway 166 (or conduit) through which gas and flux are introduced as indicated by arrow 163 from an external source 178, which is being injected or pumped into central passageway 166. FIG. 3 also shows gas passageway 159 between stator 162 and rotor shaft 161, and through which gas is introduced into the injector 160 or molten metal refining system (preferably molten aluminum). While typically flux may be provided in powder or other solid form and mixed with gas to inject it into the molten metal, there may also be applications such as future applications wherein a flux in liquid or gaseous form is utilized.

It will be appreciated by those of ordinary skill in the art that while the term "center" is used to describe the central passageway through the internal part of the rotor shaft, the passageway does not need to be right on the center axis, but instead may be offset there-from but still within the rotor shaft, all within the contemplation of this invention. In the event the central passageway is not exactly on the center axis, the rotor or rotor shaft may need to be balanced in order to reduce or eliminate vibration.

Figure 4:
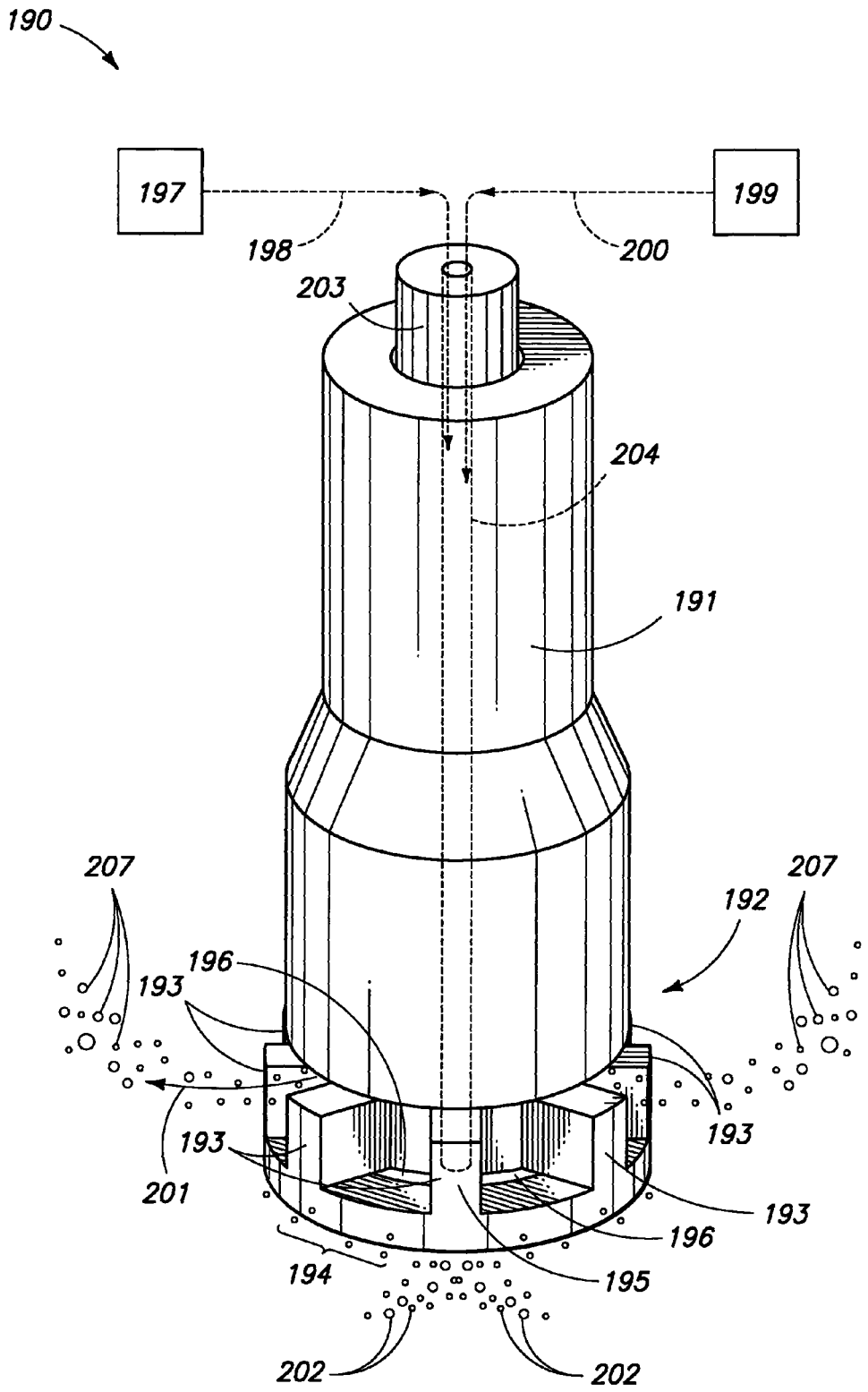
FIG. 4 is a perspective view of another embodiment of a molten metal refining system contemplated by this invention with a differently configured spinning rotor.

It will be appreciated by those of ordinary skill in the art that any one of a number of different spinning rotors may be utilized with no one in particular being required to practice this invention, all within the contemplation of this invention and depending upon the specific application of the embodiment of this invention being practiced. For example, another exemplary spinning rotor is illustrated in FIG. 4 as spinning rotor 192.

As can also be seen from FIG. 3, the rotor shaft 161 is rotatably positioned within the internal cavity within stator 162 such that it may be driving by a motor or other drive within the stator 162 cavity. The rotor shaft 161 is operably attached to the spinning rotor 167 such that the nozzle rotates with the rotor shaft 161. A gas passageway is also provided between the internal cavity surface of the stator 162 and the outer surface of the rotor shaft 161 such that gasses 164 may pass through the passageway before being discharged between the bottom of the stator 162 and the top of the spinning rotor 167. The gas is discharged and preferably sheared between the top of the spinning rotor 167 and the bottom of the stator 162, and the vanes 170 of the spinning rotor 167 contribute to the sheering of the gas bubbles 177 and dispersion thereof within the molten metal surrounding the spinning rotor 167. The stator 162 may be smooth, include vanes 170, or include any one of a number of different surfaces and configurations on the outer surface thereof, with no one in particular being required to practice this invention.

FIG. 3 also illustrates where the outer surface of the rotor shaft 161 interacts with the interior surface of the stator 162, with that intersection identified as item 179, which may also be referred to as gap 179. The area of that intersection 179 may be referred to as a bushing, a bearing, or using other terms, and there may in some embodiments be a two to four one-thousandths of an inch clearance between the two components. It is typically desirable to maintain a certain pressure of gas in that gap 179 so that molten metal does not enter the gap 179 at the lower end near the rotating rotor 167. It is typically desirable to maintain a certain pressure of gas below that gap 179 so that molten metal does not enter the gap 179 at the lower end near the rotating rotor 167.

In typical applications utilizing the gap 179, only gas is utilized in connection with the stator and rotor configuration, with any desired flux being added through a separate injector. However, embodiments of this invention, may provide for the introduction of flux in molten metal processing systems which utilize a rotating rotor and shaft within a stator.

FIG. 4 is a perspective view of another embodiment of a molten metal refining system 190 contemplated by this invention with a differently configured spinning rotor 192. FIG. 4 illustrates injector 190, stator 191, rotor shaft 203, spinning rotor 192, with blades 193, including space 194 between respective blades 193 or vanes, and lower portion 195 of spinning rotor 192 which has a continuous circumference. Gas bubbles 207 are disbursed from between the stator 191 and the spinning rotor 192.

FIG. 4 further illustrates a source of gas and flux 197, or a source of gas 199 alone, which may be pumped or injected into central passageway 204. The source of gas 199 may provide gas both to the central passageway 204 and/or to the more traditional gas passageways (as shown in FIG. 3 as passageway 159).

FIG. 4 also shows gas bubbles 202 which includes flux being dispersed from underneath the spinning rotor 192 and which originated in central passageway 204. Depending upon the specific flux material or materials utilized, the gas and solid flux material, or gas alone, may be the sole injection into the central passageway 204, or it may be combined with gases or other desired additions, all in the contemplation of this invention and with no one in particular being required to practice this invention.

As will be appreciated by those of ordinary skill in the art, the gas and flux flow rates will depend on the metal flow rate, the impurities in the incoming metal in a given application, and the desired quality of the output metal. However, in one example the gas may range flow up to five cfm (eight Nm3/h), with a typical range being in the two to four and one-half cfm (three to seven Nm3/h). The flux material in typical application may utilize up to twenty g/m or higher. The flow rates given herein are per nozzle and are given as examples and not to limit the invention in any way as it is not dependent on any particular range or set of parameters in the metal processing system.

While the preferred gas used in combination with this invention in a given embodiment is argon, nitrogen, or others may also be utilized. Although this invention is not limited to any particular flux material, a preferred flux material in a given embodiment may be a eutectic mixture of magnesium chloride and potassium chloride (which is commonly known by trademarks ProMag and Zendox).

Figures 5, 6:
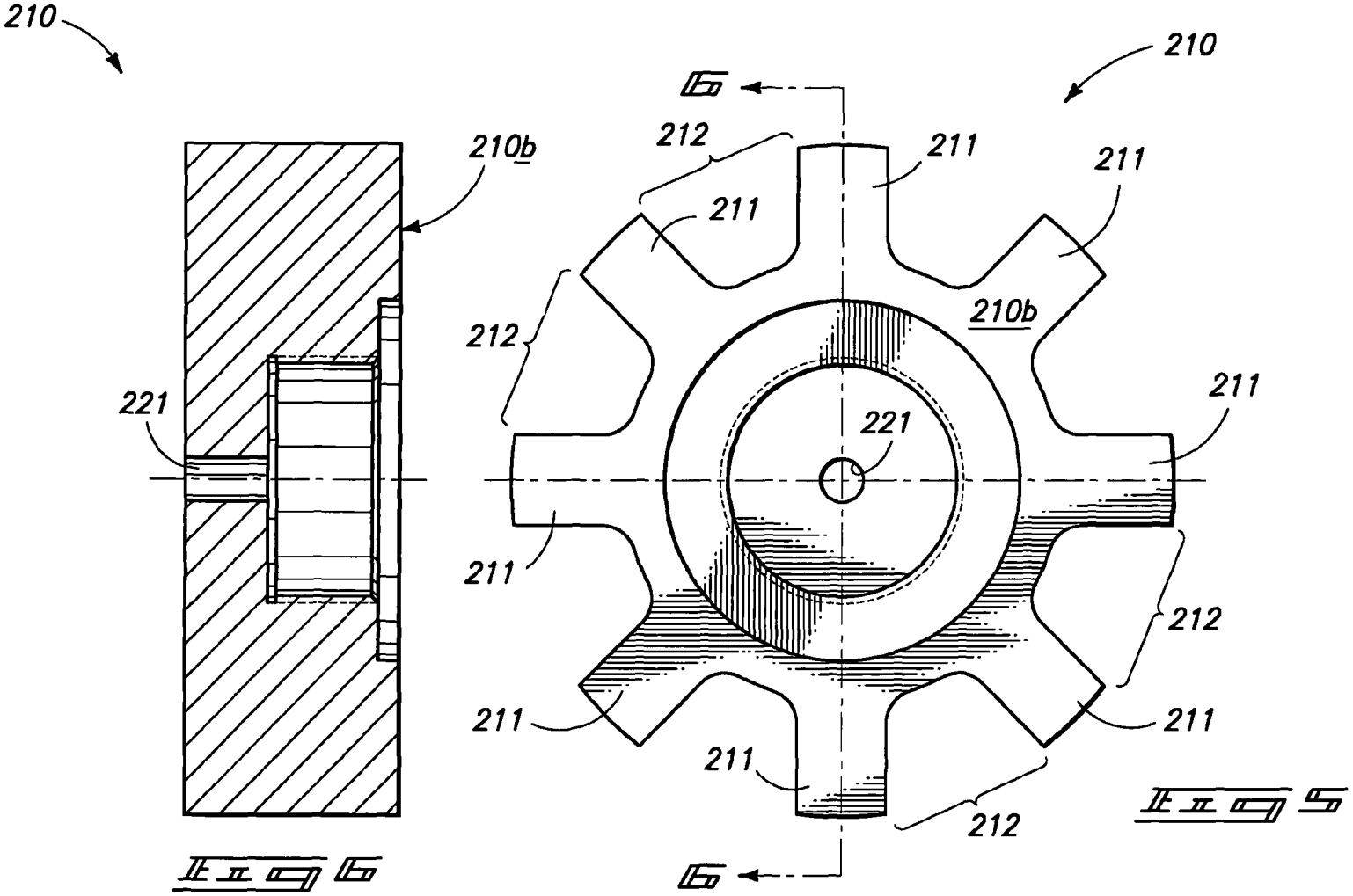
FIG. 5 is a top view of the rotor illustrated in FIG. 3.
FIG. 6 is section 6-6 from FIG. 5.

FIG. 5 is a top view of the spinning rotor 210 illustrated in FIG. 3, illustrating center or central passageway 221 in spinning rotor 210 with blades 211, top surface 210*b*, slots 212 between respective or adjacent blades 211.

It will be appreciated by those of ordinary skill in the art that the spinning rotor 210 may be one piece with the rotor shaft and considered part of the rotor shaft with which it rotates, or it may be a two piece configuration attached to the rotor shaft, all within the contemplation of this invention and depending upon the specific application of the invention.

It would be typical to make the stator, rotor and spinning rotor out of a graphite or other similar material, although no one particular material or materials is required to practice this invention. It will also be appreciated by those of ordinary skill in the art that while a couple preferred examples of rotors and stators are shown, no one particular configuration is required to practice this invention.

FIG. 6 is section 6-6 from FIG. 5, and illustrates central passageway 221 within spinning rotor 210.

FIG. 7 is a top view of the spinning rotor 250 illustrated in FIG. 4, showing a plurality of apertures 252 between blades 251, with central passageway 256 and top surface 250*b* of spinning rotor 250.

FIG. 8 is section 8-8 from FIG. 7, and illustrates central passageway 256 within spinning rotor 250.

FIG. 9 is a top view of another embodiment of a rotor 280 which may be utilized in embodiments of this invention. FIG. 9 illustrates a spinning or rotating rotor 280, a plurality of apertures 282 in the rotor 280, a plurality of blades 281, which may also be referred to as vanes or fins. The rotor 280 is configured with the apertures 282 to provide a controlled upward flow of molten metal through the apertures 282. The rotor 280 in this embodiment has an extended bottom portion, or ring, which extends beyond the outer edge 281*a* of the blades 281 by distance 286, with the outer edge 280*a* of the rotor 280 shown outwardly from the outer edge 281*a* of the blades 281. Slots 277 are shown between adjacent blades 281. The ring extending the periphery of the bottom portion for the rotor 280, may allow a more stable and more complete bubble distribution at a slower speed. Apertures 282 may also be provided with a larger area to allow more molten metal flow there-through as compared to the rotor design illustrated in FIG. 7 for example.

It will be appreciated by those of ordinary skill in the art that no one particular size or dimensions are required to utilize the ring feature in different embodiments of this invention. A ring distance may for example be configured in the one-half to three-quarter inch range for distance 286. Utilizing a ring in embodiments of this invention may also allow for the blades 281 to be deeper or longer in the vertical direction with larger apertures 282 to increase the metal flow and better allow a slower rotational speed of the rotor 280. Those in the art will also appreciate that larger apertures 282 will reduce the blockages or blockage potential of the apertures 282.

It is preferable in embodiments of this invention to control the direction of the metal flow relative to the rotor by adjusting the nozzle speed. At low speeds for instance, the molten metal will tend to flow upward and be carried by the buoyancy of the bubbles. At very high speeds, the metal and bubbles will be driven downward towards the bottom of the chamber. At interim speeds, which may be preferable in embodiments of this invention, the molten metal and bubbles will move horizontally outward from the rotor. The ring as shown may at least partially function to restrict the upward metal flow into the rotor, which may tend to promote a more stable outward flow from the rotor in a horizontal or slightly downward direction because the downward metal flow into the rotor from the top of the rotor is not as restricted.

The ring portion of the rotor 280 combined with the apertures 282, may be sized and configured to control the upward flow of molten metal into the rotor 280 to better disperse the gas out the side of the rotor 280. It will be appreciated by those of ordinary skill in the art that the size and configuration of the apertures 282 relative to the ring and the blades 281 may be based on empirical data from testing to find the best configuration for a particular application, including for a particular rotational speed, all within the contemplation of this invention, and with no one in particular being required to practice this invention.

Figures 10, 11:
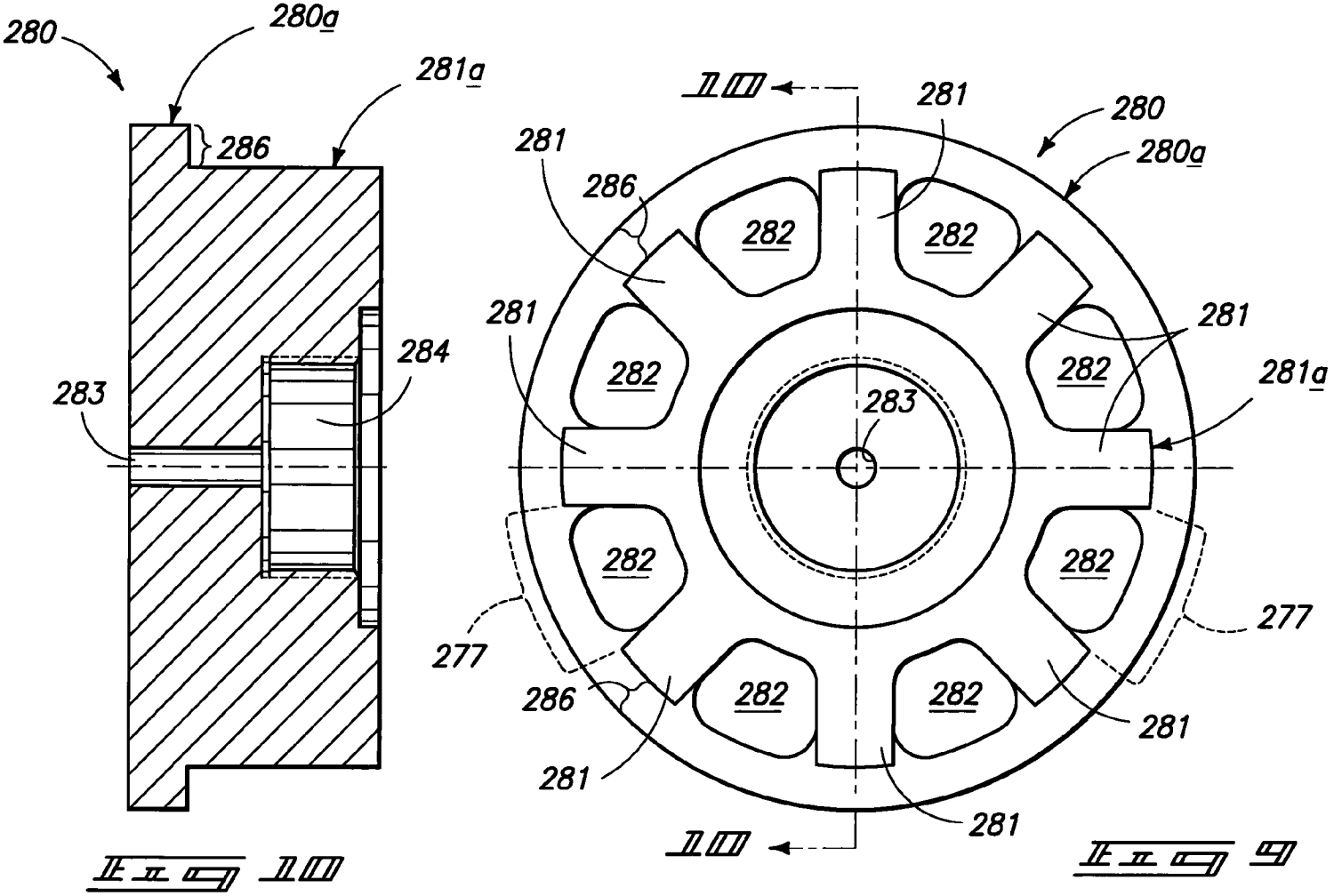
FIG. 10 is section 10-10 from FIG. 9.
FIG. 11 is an elevation view of another embodiment of a molten aluminum refining system contemplated by this invention.
Figure 11:
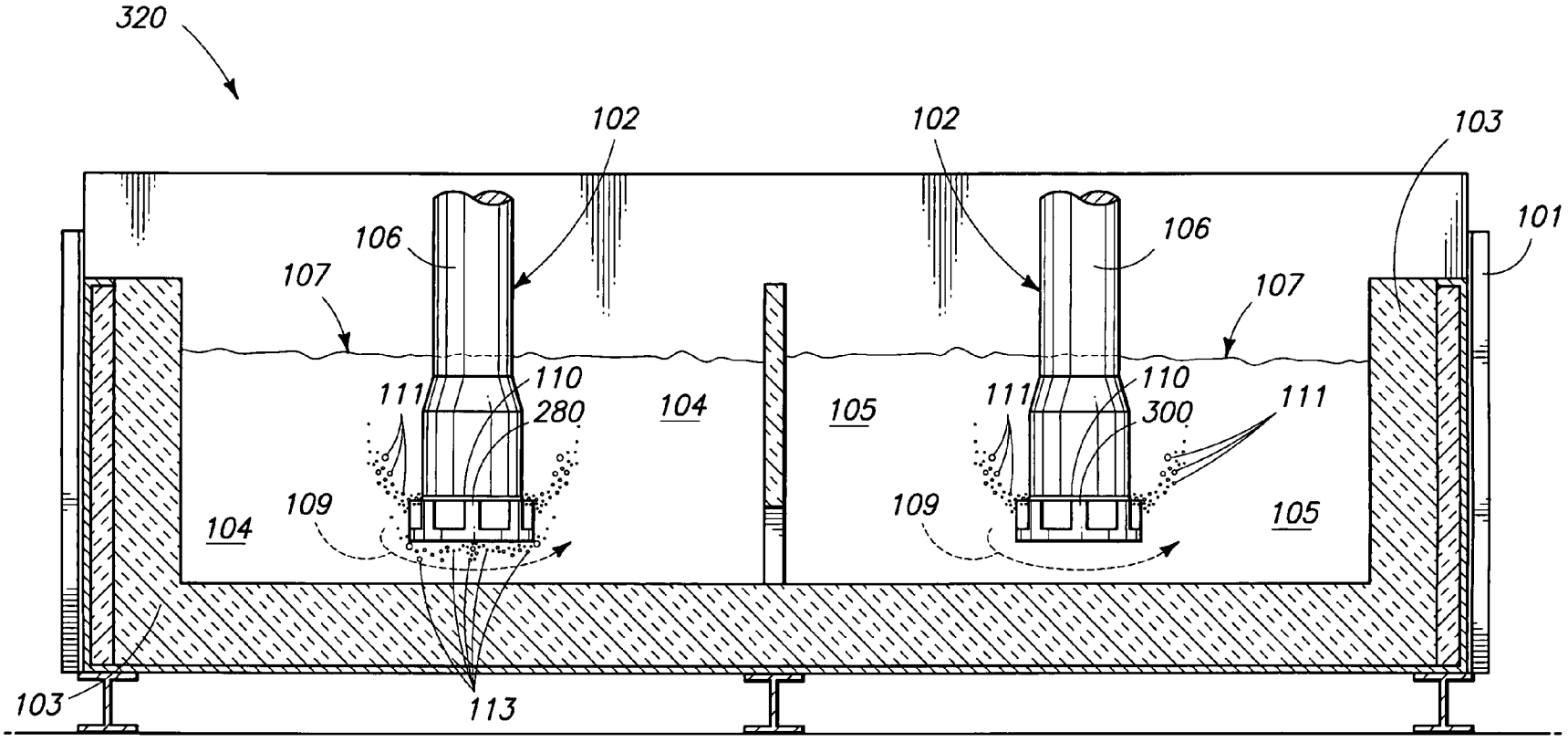
Figures 2, 3, 4:
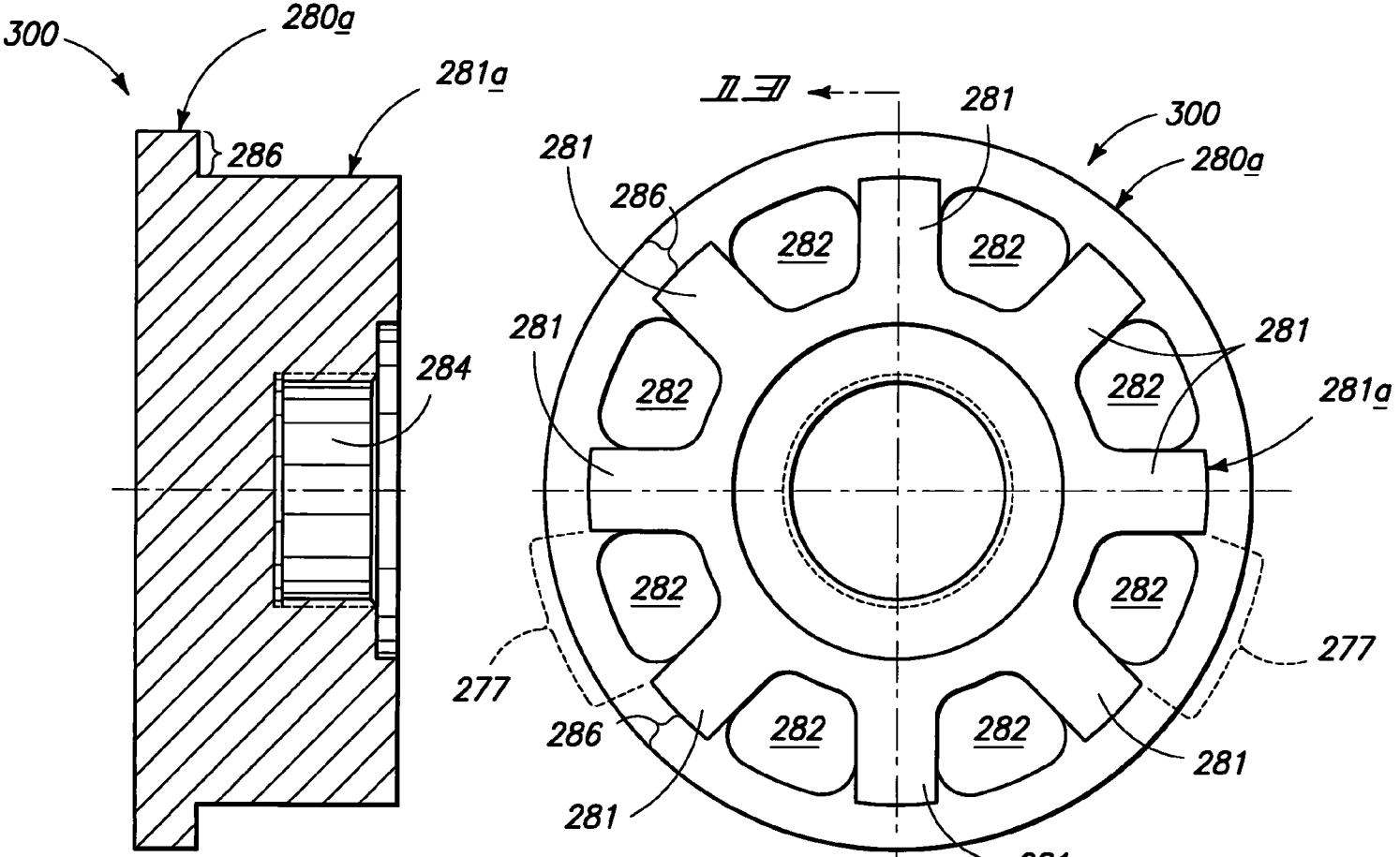

FIG. 10 is section 10-10 from FIG. 9, and illustrates central passageway 283 within spinning rotor 280.

The embodiment of the rotor 280 illustrated in FIGS. 9 and 10 may be utilized in applications where lower speed (revolutions per minute or rpm's) is desired. While there are any one of a number of different possibilities for the preferred revolutions per minute to run the rotor at for a given application, the rotor 280 in FIGS. 9 and 10 may be run at slower speeds such as one hundred to two hundred revolutions per minute. While the speed of a rotor in a given embodiment may typically be up to eight hundred rpm's, the typical nozzle application will be in the three hundred to seven hundred revolutions per minute range. This invention however is not limited to any particular range or values of revolutions per minute or specific process parameters, which may change depending on the process factors in a given application or embodiment.

It will be appreciated by those of ordinary skill in the art that it may be preferred in some applications of some embodiments of this invention, to run the rotor 280 at a lower rate to maintain a calmer surface level of the molten metal and avoid a vortex effect.

FIG. 11 is an elevation view of another embodiment of a molten aluminum refining system 320 contemplated by this invention, such as a containment or refining vessel, 101, illustrating two injectors 102, refractory lining 103, stators 106 within vessel compartments 104 and 105, molten metal level 107, such as molten aluminum. The like components in this embodiment with the embodiment illustrated in FIG. 1 are labeled with the same item numbers for ease of reference and consistency.

This embodiment illustrates two different spinning rotors 280 and 300, which are as illustrated in FIG. 9 and FIG. 12 respectively. Each of the spinning rotors 280 and 300 are spinning as indicated by arrows 109, with rotor 280 including a central passageway for injecting gas bubbles which may include flux 113 are being dispersed from a central passageway or central passageway, and gas bubbles 111 which do not contain flux are being dispersed from between the stators 106 and the rotor 110. However rotor 300 does not include a central passageway (see description below relative to FIGS. 12 and 13), and therefore gas bubbles are not shown in connection therewith. FIG. 11 illustrates a preferred embodiment of a two chamber refining system with a combination of the two different rotors 280 and 300. It will also be appreciated by those of ordinary skill in the art that any combination of rotors that are capable of injecting flux such as rotors 210, 250 and 280, and rotors that do not inject flux such as rotors 134 and 300, can be used in a single and multiple chamber refining systems.

It will also be appreciated by those of ordinary skill in the art that a similar rotor without the central passageway 283 may be utilized in applications where lower speed (revolutions per minute or rpm's) is desired and flux injection is not required. An example of this rotor is shown as item 300 in FIG. 11, and in FIGS. 12 and 13.

FIG. 11 also illustrates how apertures in the rotors 280 and 300 may create an upward flow 114 of molten metal through apertures such as apertures 282 as shown in FIG. 9 and FIG. 12.

FIG. 12 is a top view of an embodiment of a rotor 300 which may be utilized in embodiments of this invention when flux is not required. FIG. 12 illustrates a spinning or rotating rotor 300, a plurality of apertures 302 in the rotor 300, a plurality of blades 301, which may also be referred to as vanes or fins. The components and items in FIGS. 12 and 13 which are like items to those in FIGS. 9 and 10 are like numbered.

FIG. 13 is section 13-13 from FIG. 12 and all items are numbered the same as in FIG. 12, and therefore will not be repeated here.

The alternative embodiments of rotors illustrated herein, such as in FIGS. 7, 9 and 12, may be utilized in combination with injectors and provided with gas or gas and flux as shown and described elsewhere herein, such as in FIG. 4.

As will be appreciated by those of reasonable skill in the art, there are numerous embodiments to this invention, and variations of elements and components which may be used, all within the scope of this invention.

One embodiment of this invention, for example, is a gas dispersion apparatus for the injection of gas and flux into molten metal, comprising: an elongated stator with an internal cavity; a rotor including a rotor shaft, wherein the rotor shaft is rotatably mounted within the internal cavity of the stator; a passageway between an internal wall of the internal cavity in the stator and an outer wall of the rotor shaft to facilitate gas discharge at or near a top of the rotor; and a central passageway from a top portion of the rotor shaft extending through to a bottom of the rotor, the central passageway providing a passageway for gas and flux to be discharged at the bottom of the rotor.

In one example of a process embodiment of the invention, a process for simultaneously dispersing gas and flux into molten aluminum may be provided, comprising the following: providing an elongated stator with an internal cavity providing a rotor including a rotor shaft, wherein the rotor shaft is rotatably mounted within the internal cavity of the stator; providing a gas passageway between an internal wall of the internal cavity in the stator and an outer wall of the rotor shaft to facilitate gas discharge at or near a top of the rotor; providing a central passageway from a top portion of the rotor shaft extending through to a bottom of the rotor; rotating the rotor within molten aluminum; injecting gas into the gas passageway such that it is discharged into the molten aluminum between the rotor and the stator; and injecting gas and flux into the central passageway such that it is discharged into the molten aluminum at the bottom of the rotating rotor.

In yet another embodiment of the invention, a bladed rotor for incorporation in a spinning nozzle assembly is provided, which is adapted for the injection of gas into molten aluminum present in a refining chamber during aluminum refining operations therein, said bladed rotor comprising: a rotor periphery with an upper periphery which includes alternate blades and slots around the upper periphery, and with a lower periphery which includes a ring extending radially beyond the upper periphery; and wherein the ring contains apertures therein which coincide with the slots and which provide for a controlled upward passage of molten aluminum therethrough upon use of said rotor for aluminum refining operations.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A gas dispersion apparatus for the injection of gas and flux into molten metal, comprising:

an elongated stator with an internal cavity;

a rotor including a rotor shaft, wherein the rotor shaft is rotatably mounted within the internal cavity of the stator;

a passageway between an internal wall of the internal cavity in the stator and an outer wall of the rotor shaft to facilitate gas discharge at or near a top of the rotor;

a central passageway from a top portion of the rotor shaft extending through to a bottom of the rotor, the central passageway providing a passageway for gas and flux to be discharged at the bottom of the rotor simultaneously with and independently from the gas discharge at or near a top of the rotor; and a source of flux including solids external to the central passageway operably connected to the central passageway and configured to inject flux from the source of flux through the central passageway and discharged at the bottom of the rotor;

further wherein the rotor further comprises:

a rotor periphery with an upper periphery which includes alternate blades and slots around the upper periphery, and with a lower periphery which includes a ring extending radially beyond the blades of the upper periphery; and wherein the ring contains apertures therein which coincide with the slots and which provide for the passage of molten aluminum there-through upon use of said rotor for aluminum refining operations.

2. A gas dispersion apparatus for the injection of gas and flux into molten metal as recited in claim 1, and further wherein the source of flux is configured to provide solid flux through the central passageway.

3. A bladed rotor for incorporation in a spinning nozzle assembly adapted for the injection of gas into molten aluminum present in a refining chamber during aluminum refining operations therein, said bladed rotor comprising:

a rotor periphery with an upper periphery which includes alternate blades and slots around the upper periphery, and with a lower periphery which includes a ring extending radially beyond the blades of the upper periphery; and wherein the ring contains apertures therein which coincide with the slots and which provide for a controlled upward passage of molten aluminum there-through upon use of said rotor for aluminum refining operations.

4. A bladed rotor for incorporation in a spinning nozzle assembly adapted for the injection of gas into molten aluminum present in a refining chamber during aluminum refining operations therein as recited in claim 3, and further wherein the ring forms a continuous outer periphery.

5. A bladed rotor for incorporation in a spinning nozzle assembly adapted for the injection of gas into molten aluminum present in a refining chamber during aluminum refining operations therein as recited in claim 3, and further wherein the ring extending radially beyond the upper periphery provides an outer surface for the apertures at approximately the outer periphery of the blades.

6. A bladed rotor for incorporation in a spinning nozzle assembly adapted for the injection of gas into molten aluminum present in a refining chamber during aluminum refining operations therein as recited in claim 3, and wherein the bladed rotor further comprises a center passageway configured to receive flux from a source of flux.

7. A bladed rotor for incorporation in a spinning nozzle assembly adapted for the injection of gas into molten aluminum present in a refining chamber during aluminum refining operations therein as recited in claim 6, and wherein the center passageway configured to receive solid flux from a source of flux and to deliver the solid flux through the center passageway below the bladed rotor.

8. A gas dispersion apparatus for the injection of gas and flux into molten metal, comprising:

an elongated stator with an internal cavity;

a bladed rotor including a rotor shaft, wherein the rotor shaft is rotatably mounted within the internal cavity of the stator;

a passageway between an internal wall of the internal cavity in the stator and an outer wall of the rotor shaft to facilitate gas discharge at or near a top of the rotor;

a central passageway from a top portion of the rotor shaft extending through to a bottom of the rotor, the central passageway providing a passageway for gas and flux to be discharged at the bottom of the rotor, simultaneously with and independently from the gas discharge at or near a top of the rotor;

a source of flux operably connected to the central passageway and configured to inject flux from the source of flux through the central passageway and discharged at the bottom of the rotor;

wherein the bladed rotor comprises:

a bladed rotor central passageway operatively connected to and continuous with the central passageway in the stator;

a rotor periphery with an upper periphery which includes alternate blades and slots around the upper periphery, and with a lower periphery which includes a ring extending radially beyond the blades around the upper periphery; and wherein the ring contains apertures therein which coincide with the slots and which provide for a controlled upward passage of molten aluminum there-through upon use of said rotor for aluminum refining operations.

9. A gas dispersion apparatus for the injection of gas and flux into molten metal as recited in claim 8, and further wherein the flux including solids is flux in a powdered form.

* * * * *